United States Patent [19]

Bothwell et al.

[11] Patent Number: 4,979,781

[45] Date of Patent: Dec. 25, 1990

[54] BENCH MINING METHOD AND APPARATUS

[75] Inventors: John C. Bothwell; Glen H. Doyle, both of Calgary, Canada

[73] Assignee: G.D. Mechanial Design Ltd., Calgary, Canada

[21] Appl. No.: 404,985

[22] Filed: Sep. 11, 1989

[51] Int. Cl.[5] ..... E21B 41/00; E21B 47/04; E02F 5/08

[52] U.S. Cl. ..... 299/18; 37/97; 37/190; 299/19; 299/73

[58] Field of Search ..... 299/10, 18, 19, 39, 299/73, 75; 37/41, 94, 95, 97, 189, 190, 195

[56] References Cited

U.S. PATENT DOCUMENTS

| | | | |
|---|---|---|---|
| 2,140,823 | 12/1938 | Van Voorhis | 37/190 X |
| 3,157,956 | 11/1964 | Penote | 37/97 |
| 3,994,083 | 11/1976 | Cunningham | 37/91 X |
| 4,103,972 | 8/1978 | Kochanowsky | 299/18 |
| 4,794,709 | 1/1989 | Rivard | 37/91 X |

FOREIGN PATENT DOCUMENTS

| | | |
|---|---|---|
| 881371 | 9/1971 | Canada . |
| 906010 | 7/1972 | Canada . |
| 984418 | 1/1976 | Canada . |
| 1010461 | 5/1977 | Canada . |
| 1034973 | 7/1978 | Canada . |

*Primary Examiner*—Bruce M. Kisliuk
*Assistant Examiner*—David J. Bagnell
*Attorney, Agent, or Firm*—Adrian D. Battison; Stanley G. Ade; Murray E. Thirft

[57] ABSTRACT

A method and apparatus for bench mining employs a rotating wheel excavator with excavator wheel positioned outwardly to one side of a tractor unit for the excavator so that the tractor unit draws the excavation wheel along a bench line or cut line between different layers of the bench mine. The cutting wheel can either be moved to opposite sides of the tractor unit or a second wheel can be positioned at the other side so that the excavator can operate in both directions of movement.

2 Claims, 5 Drawing Sheets

BENCH MINING METHOD AND APPARATUS

BACKGROUND OF THE INVENTION

This invention relates to improvements in bench mining method and apparatus.

Bench mining is a system in which a layer of usable product or overburden at the surface of the earth is mined by cutting the layer into a plurality of separate levels or benches each separated from the next in height by a substantially vertical cut line.

This enables cutting to be carried out at each bench line or cut line by suitable equipment simultaneously with the cut material being transported from the mine on conveyers.

Various arrangements have been proposed for this technique. Generally a large articulated arm arrangement is positioned centrally of the bench line and operates to transport a cutting device along the bench line. However as equipment becomes larger and larger to achieve economies of scale, this technique has found limitations and difficulties in the basic engineering of equipment on that scale.

SUMMARY OF THE INVENTION

Accordingly it is one object of the present invention to provide an improved method and apparatus of bench mining of this type.

According to a first aspect of the invention, therefore, there is provided a method of bench mining a layer of usable product or overburden at the surface of the earth comprising forming three or more separate levels or benches in said layer each separated from the next in height by a substantially vertical cut line defining thereat a higher level and a lower level, providing at each cut line one of a plurality of separate vehicles, each vehicle being powered and driven separately from the other vehicles, moving said one vehicle along said higher level at the cut line in a first direction, mounting on the vehicle an excavator wheel assembly for movement therewith with the wheel assembly at a position rearwardly, downwardly and at least partly to one side of the vehicle, rotating the excavator wheel assembly about a horizontal axis substantially at right angles to the direction of movement, the wheel assembly including a plurality of peripherally arranged digging means whereby movement of the vehicle along the cut line causes the wheel to cut a band of product from the higher level at the cut line down to the lower level, at an end of said cut line, turning the vehicle through 180° so as to move along the cut line in a direction opposed to said first direction, moving the wheel assembly to a position rearwardly, downwardly and to a side of the vehicle opposed to said one side and conveying the cut product from each of the vehicles to a common extraction conveyor.

According to a second aspect of the invention there is provided an apparatus for bench mining a layer of usable product or overburden at the surface of the ground in a method of the type in which a plurality of separate levels or benches are formed in said layer each separated from the next in height by a substantially vertical cut line, the apparatus comprising a wheel excavator assembly arranged for rotation about a substantially horizontal axis, a vehicle for supporting the wheel the wheel assembly and having ground engaging support means for movement of the vehicle and wheel assembly in a direction of movement substantially at right angles to said axis of rotation of the wheel with the wheel assembly trailed behind the vehicle, said wheel having a plurality of digger means arranged around its periphery so as to move from a lowermost point on the wheel assembly forwardly and upwardly to cut a band of the product as the wheel rotates and as it is transported forwardly by movement, of the vehicle along the ground on said support means, said wheel assembly movable relative to the vehicle in a direction transversely to the direction of movement and parallel to the axis of rotation thereof from a first position arranged to cut a band at lest part of which lies outwardly beyond one side of said vehicle to a second position arranged to cut a band at least part of which lies outwardly beyond an opposed side of the vehicle and being movable in a vertical direction to vary the depth of cut to a position below the ground engaging support means of the vehicle, and conveyer means for conveying the product away from the vehicle.

With the foregoing in view, and other advantages as will become apparent to those skilled in the art to which this invention relates as this specification proceeds, the invention is herein described by reference to the accompanying drawings forming a part hereof, which includes a description of the best mode known to the application and of the preferred typical embodiment of the principles of the present invention, in which:

DESCRIPTION OF THE DRAWING(

In the drawings like characters of reference indicate corresponding parts in the different figures.

DETAILED DESCRIPTION

Figure 1:
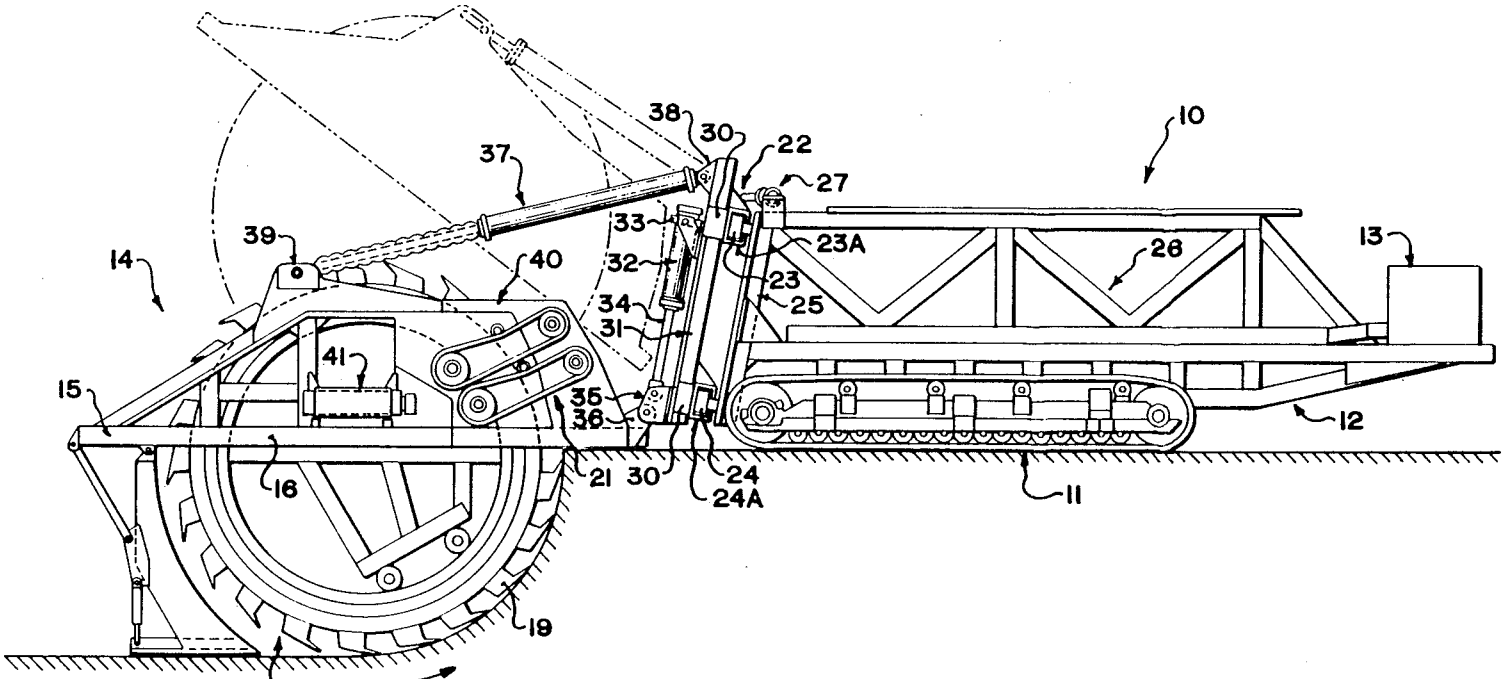
FIG. 1 is a side elevation of a continuous wheel excavator showing one embodiment of the invention.
Figure 2:
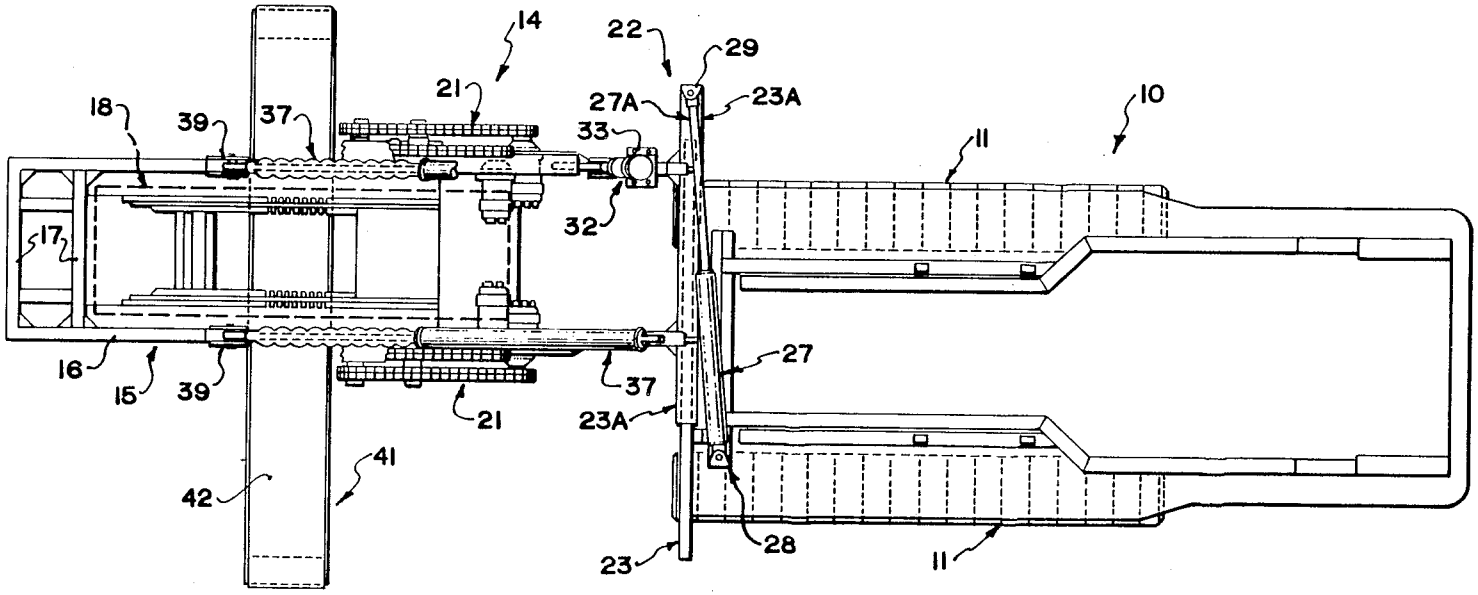
FIG. 2 is a top plan view of FIG. 1.

Proceeding therefore to describe the invention in detail, reference should first be made to FIGS. 1 and 2 which show a tractive unit collectively designated 10 which consists of a crawler-type tractive unit having endless track 11 on each side of a frame generally designated 12 and driven from a source of power indicated at 13. Although a twin endless track tractive unit is shown, nevertheless it will be appreciated that any form of tractive unit can be used to pull the device collectively designated 14 including an onboard winch pulling against a wire rope attached to a deadman at the other end of the cut or by any other such means.

The invention designated 14 includes a substantially rectangular wheel frame 15 including a pair of spaced and parallel longitudinal frame members 16 and cross members 17 mounting a continuous excavator wheel assembly collectively designated dig for rotation within the frame and between the longitudinal members 16. The construction of the excavator wheel assembly 18 is conventional and includes digging buckets 19 around the periphery of the wheel which rotates in the direction of arrow 20. Drive for the wheel, in this particular embodiment, is by hydraulic motors (not illustrated) via chain or belt assemblies 21, all of which is conventional.

An excavating wheel sub-frame assembly collectively designated 22 is secured to the rear of the tractive unit 10 an includes a pair of spaced and parallel, transversely extending fixed rails, namely an upper transverse rail 23 and a lower transverse rail 24.

These rails are secured to the rear side upright members 25 of the superstructure collectively designated 26 of the tractive :lnit frame 12.

These rails are preferably of rectangular cross section and slideably receive elongated sleeves 23A and 24A having a cross section similar to the rails 23 and 24 upon which they slide transversely.

A hydraulically operated piston and cylinder assembly 27 is secured by one end to the superstructure 26 by means of pivot mounting 28. The piston rod 27A is secured by the distal ends thereof to a bracket 29 and one end of the upper slide member 23A as clearly shown in FIG. 2 so that retraction and extension of the piston and cylinder assembly moves the slide unit from one side to the other of the tractive unit.

Upper and lower brackets or sleeves 30 are secured inboard of each end of the slide members 23 and 24 and are also preferably of rectangular cross section to receive substantially vertically mounted members 31 which are mounted for substantially up and down movement within these sleeves 30, controlled by a further piston and cylinder assembly 32, secured at one end to bracket 33 secured to one of the upper sleeves 30 and by the distal end of the piston rod 34, to a bracket 35 extending from the corresponding lower sleeve 30 as clearly shown in FIG. 1.

The aforementioned wheel excavator frame 15 is pivotally secured by means of brackets 36, to corresponding brackets 35 extending from each of the lower sleeve 30, one bracket 35 carrying the lower end of piston rod 34.

Another piston and cylinder assembly collectively designated 37 extends between a bracket 38 on one of the substantially vertical sliding members 31 and an anchor point 39 extending upwardly from the upper member 40 of the wheel frame 15.

As mentioned previously , the piston and cylinder assembly 27 moves the entire slide unit together with the wheel assembly transversely relative to the tractive unit. The piston and cylinder assembly 32 moves the entire wheel assembly rearwardly and downwardly along the substantially vertical slide members 31 and the piston and cylinder assembly 37 pivots the wheel assembly and frame 15 around the pivot points between brackets 35 and 36 thus moving the wheel assembly from the position shown in solid line in FIG. 1 to the position shown in phantom and vice versa, it being understood that all of the piston and cylinder assemblies and the drive for the wheel assembly 18 are operatively connected to the tractive unit and operated therefrom.

In this particular embodiment, the entire wheel assembly is adapted to move from side to side transversely within the confines of the width of the tractive unit or, alternatively, to position slightly outboard of either side of the tractive unit.

A conventional discharge conveyer collectively designated 41 is situated transversely through the wheel substantially centrally thereof but slightly behind the transverse centre line so that material picked up by the buckets may be dumped upon an endless belt 42 which may be driven in either direction so that the removed material can be dumped on either side of the conveyer depending upon circumstances. This endless conveyer is also controlled hydraulically from the tractive unit and is conventional in configuration.

FIGS. 3 through 9 show schematically, alternative embodiments of the basic concept.

Figure 3:
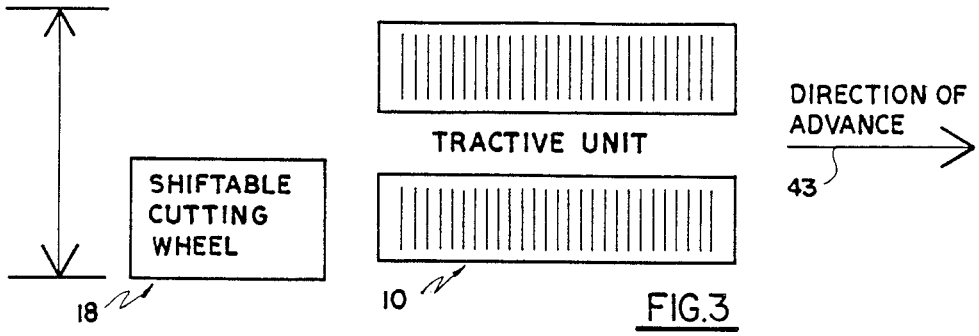
FIG. 3 is a schematic plan view of the design shown in FIGS. 1 and 2.

FIG. 3 is a schematic representation of the device shown in FIGS. 1 and 2. It consists of the cutting wheel assembly 18, and the tractive unit 10 advancing in the direction of arrow 43.

The features of this embodiment include the following:

(a) a single cutting wheel.
(b) a cutting wheel being mounted within a frame in such a way that the wheel can be positioned through a range of settings from side to side as shown.
(c) complete control of the cutting depth by means of the piston and cylinder assemblies 32 and 37.
(d) primary position of the cutting wheel in horizontal and vertical planes. However, one version of this design may also include a mechanism to tilt the wheel at an angle to the centre line plane through the tractive unit.
(e) the conveyer through the cutting wheel is preferably constructed in segments and is reversible.

Advantages include the shifting of the wheel in the horizontal plane thus allowing a cut to be made outside of the track widths and secondly, with the wheel cutting beyond the edge of the track, successive cuts can be taken and the machine car bench mine in either direction.

Figure 4:
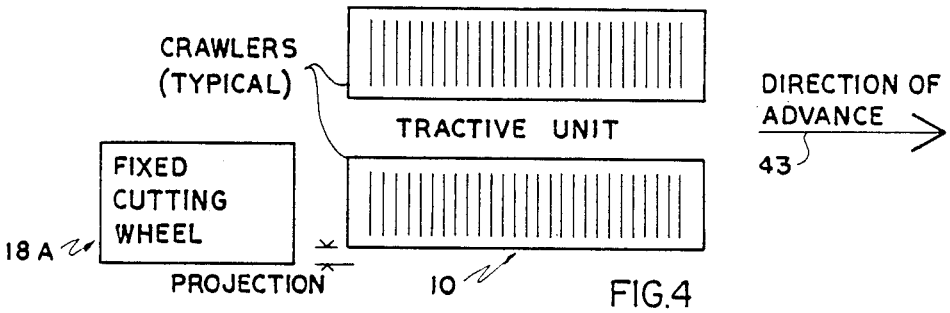
FIG. 4 is a schematic plan view showing a fixed continuous wheel excavator.

The embodiment shown in FIG. 4 shows a fixed cutting wheel assembly 18A situated behind the tractive unit 10 and projecting slightly beyond one side of the tractive unit.

The features of this embodiment include the following:

(a) a single cutting wheel.
(b) the cutting wheel is held within a frame that is fixed in one position relative to the centre line of the tractive unit.
(c) adjustments to the tracking line of the wheel, in operation, are made by means of differential movement of the right and left crawler tracks.
(d) complete control of the cutting depth as hereinbefore described in the previous embodiments.
(e) additional features such as the tilting of the cutting wheel may be added as hereinbefore explained.
(f) the conveyer through the open centre of the cutting wheel is fixed and conveys in one direction only.

Advantages include firstly that the cutting wheel and support frame are fixed in one position so that the structural integrity of the machine is enhanced and secondly, this configuration allows successive cuts to be taken for bench mining in one direction.

Figure 5:
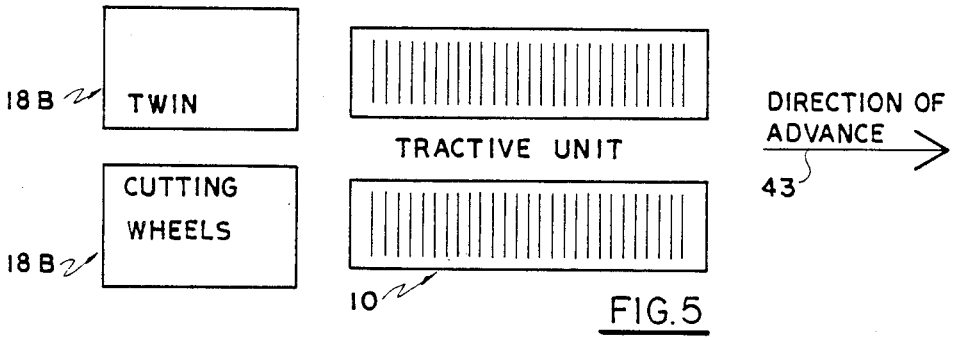
FIG. 5 is a schematic plan view showing a pair of continuous wheel excavators.

The embodiment shown in FIG. 5 shows a pair of cutting wheels in side by side relationship behind the tractive unit 10, said cutting wheels being identified by reference character 18B.

The features of this embodiment are as follows:

(a) two cutting wheels that are identical.

(b) the dual wheels are held by a pair of frames that are fixed relative to the central line of the tractive unit.

(c) the cutting width of either wheel extends beyond the edge of the tracks.

(d) corrections to the tracking line of the operating machine are by means of differential crawler track movement (e) there is complete control of the cutting dept of either wheel as they are mounted independently.

(f) the conveyer passes through the open circle of both wheels and is in segments and is reversible.

Advantages include firstly that the twin wheels cutting beyond the track width enables successive cuts to be taken for bench mining in either direction. Secondly the twin wheels will cause a balance drag force on the tractive unit and eliminate or reduce the need for differential crawler motion and thirdly either wheel may be used with the other in an idle position so that it may operate similar to the design shown in FIG. 4.

Figure 6:
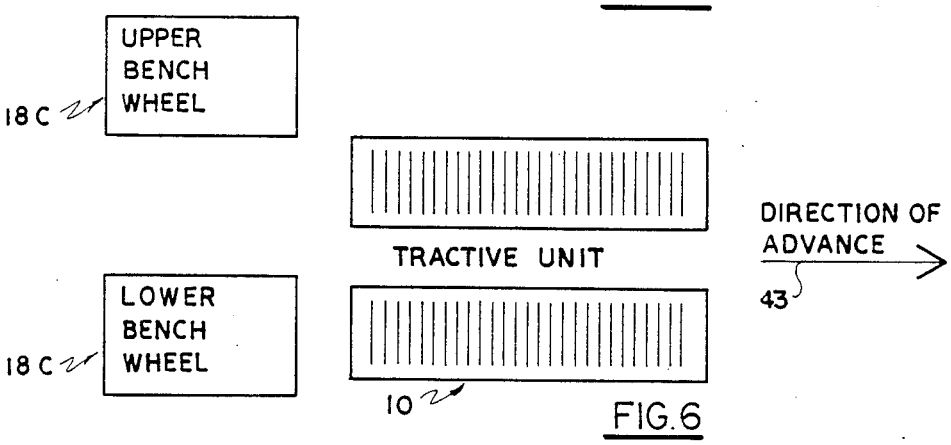
FIG. 6 is a schematic plan view showing an upper and lower continuous wheel excavator.

FIG. 6, an upper and lower bench wheel cutter is shown, each extending upon the adjacent side of the tractive unit and these are indicated by reference character 18C with the tractive unit being identified by reference character 10.

The features of this embodiment includes the following:

(a) two cutting wheels of similar but not necessarily identical design may be utilized.

(b) each wheel is supported by a frame that is fixed relative to the centre line of the tractive unit.

(c) as indicated, the upper bench wheel is positioned outside the track line on the high wall side and would cut material above the base of the crawler elevation.

(d) the lower bench will cut below the elevation of the base of the crawlers.

(e) complete control of the cutting depth of either wheel in a manner similar to that hereinbefore described.

(f) the discharge conveyer passes through the open circle of both wheels and is fixed and unidirectional.

Advantages include firstly, a machine of this configuration has a greater overall cutting depth than the previous designs. Secondly, the upper bench wheel can be used to prepare an operating level one cut in advance and thirdly, successive cuts may be taken in one direction.

Figure 7:
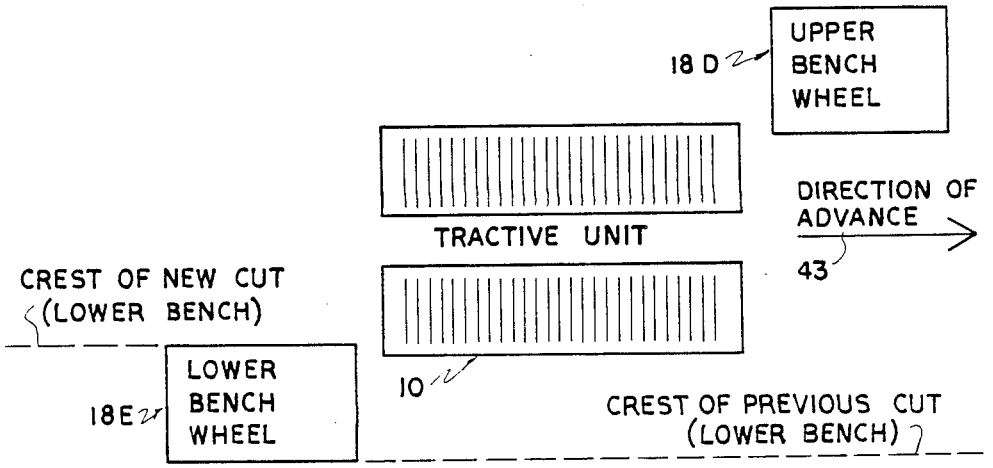
FIG. 7 is a schematic plan view showing an upper continuous wheel excavator in advance of the tractive unit on one side thereof and a lower continuous wheel excavator behind the tractive unit and on the other side thereof.

FIG. 7 shows an embodiment with a tractive unit and having upper and lower bench wheels, one upon each side of the unit with the upper bench wheel being in advance of the tractive unit and the lower bench being behind and o the opposite side thereof. Once again the tractive unit is identified by reference character 10 with the upper bench wheel being indicated by reference character 18D and the lower bench wheel be reference character 18E.

The features of this embodiment include:

(a) two cutting wheels of similar but not necessarily identical design.

(b) the upper bench wheel excavates off the forward quarter of the tractive unit preparing the bench one cut width in advance and to the elevation of the base of the crawlers.

(c) the lower bench wheel excavates at the rear quarter.

(d) each cutting wheel requires a discharge conveyer.

Advantages include firstly that the device may be used in areas where soil stability is a problem. This configuration places the crawler tracks one cut width over from the crest of the previous cut thus introducing a safety berm for the protection of the machine and the operator. Secondly, the machine can take successive cuts in one direction.

Figure 8:
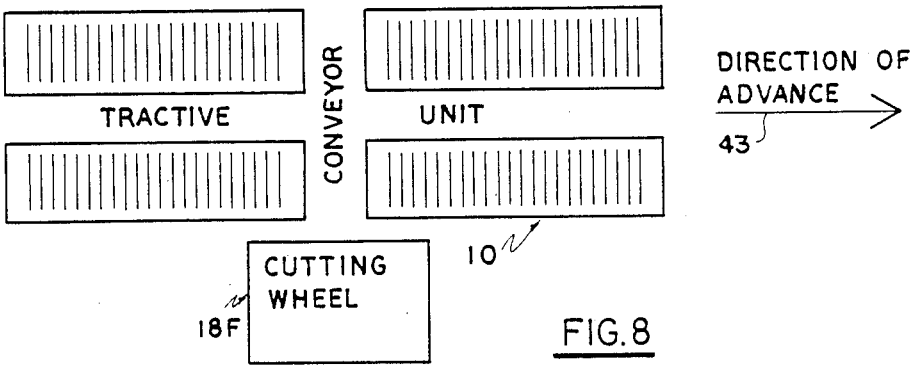
FIG. 8 is a schematic plan view showing a continuous wheel excavtor to one side of the tractive unit.

In FIG. 8, it will be noted that the tractive unit collectively designated 10 is provided with a cutter wheel assembly collectively designated 18F to one side of the tractive unit.

The features include the following:

(a) a single cutting wheel held within a frame that projects to the side of the tractive unit.

(b) there is complete control of the cutting dept which, in this configuration, is below the base of the crawler elevation.

(c) an alternative to this design may have the cutting wheel attached to the side opposite to the side shown, with two continuous crawlers. This machine will excavate above the base of the crawler elevation.

(d) the discharge conveyer passes through the centre of the cutting wheel and continues through the tractive unit as shown.

The principal advantage of this device is the articulation between the two halves of the tractive unit which can provide greater steering control.

The crawlers are offset from the high wall crest and the machine can take successive cuts in one direction.

Figure 9:
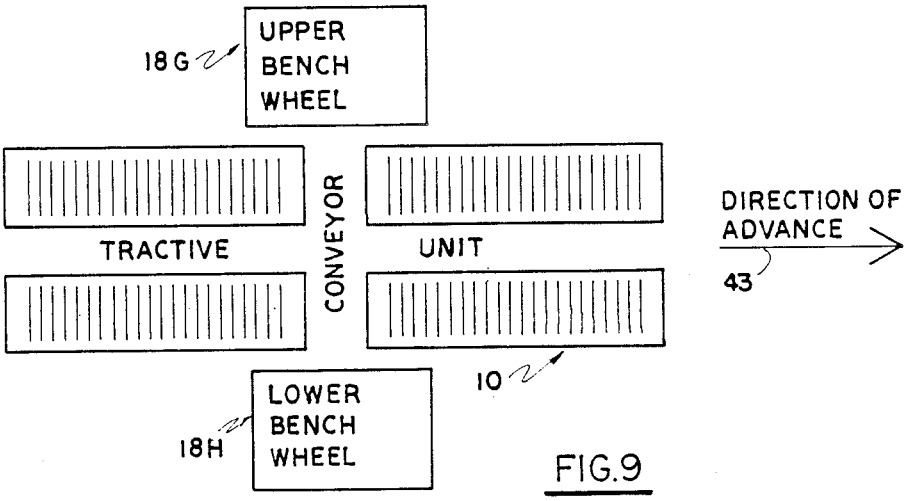
FIG. 9 is a schematic plan view similar to FIG. 8, but showing an upper bench wheel excavator on one side of the tractive unit and a lower bench wheel excavator on the other side thereof with a conveyer therebetween.

FIG. 9 shows an embodiment somewhat similar to that of FIG. 8 which includes an upper bench wheel 18G on one side of the tractive unit collectively designated 10 and a lower bench wheel 18H on the other side thereof.

The features are as follows:

(a) two cutting wheels are similar, but not necessarily identical in design.

(b) there is complete control of the cutting depth of each wheel. The upper bench wheel excavates down to the level of the base of the crawlers and the lower bench wheel excavates below the level of the base of the crawlers.

(c) the discharge conveyer passes through the open centre of each cutting wheel and through the middle of the articulated tractive unit as shown.

The advantages of this particular embodiment include firstly the articulation between the two halves of the tractive unit which can provide greater steering control. Secondly, greater overall cutting depth is achieved as compared to the previous design of FIG. 8.

Thirdly, the crawlers are offset from the high wall crest and fourthly, the machine can take successive cuts in one direction.

All of the embodiments show a new concept and different application to that of similar equipment utilized in the past.

It will be appreciated that he intended use of this machine is the mining of ore and the stripping of overburden waste from conventional open pit mines by the continuous excavation of successive slices in suitably competent material.

Figure 10:
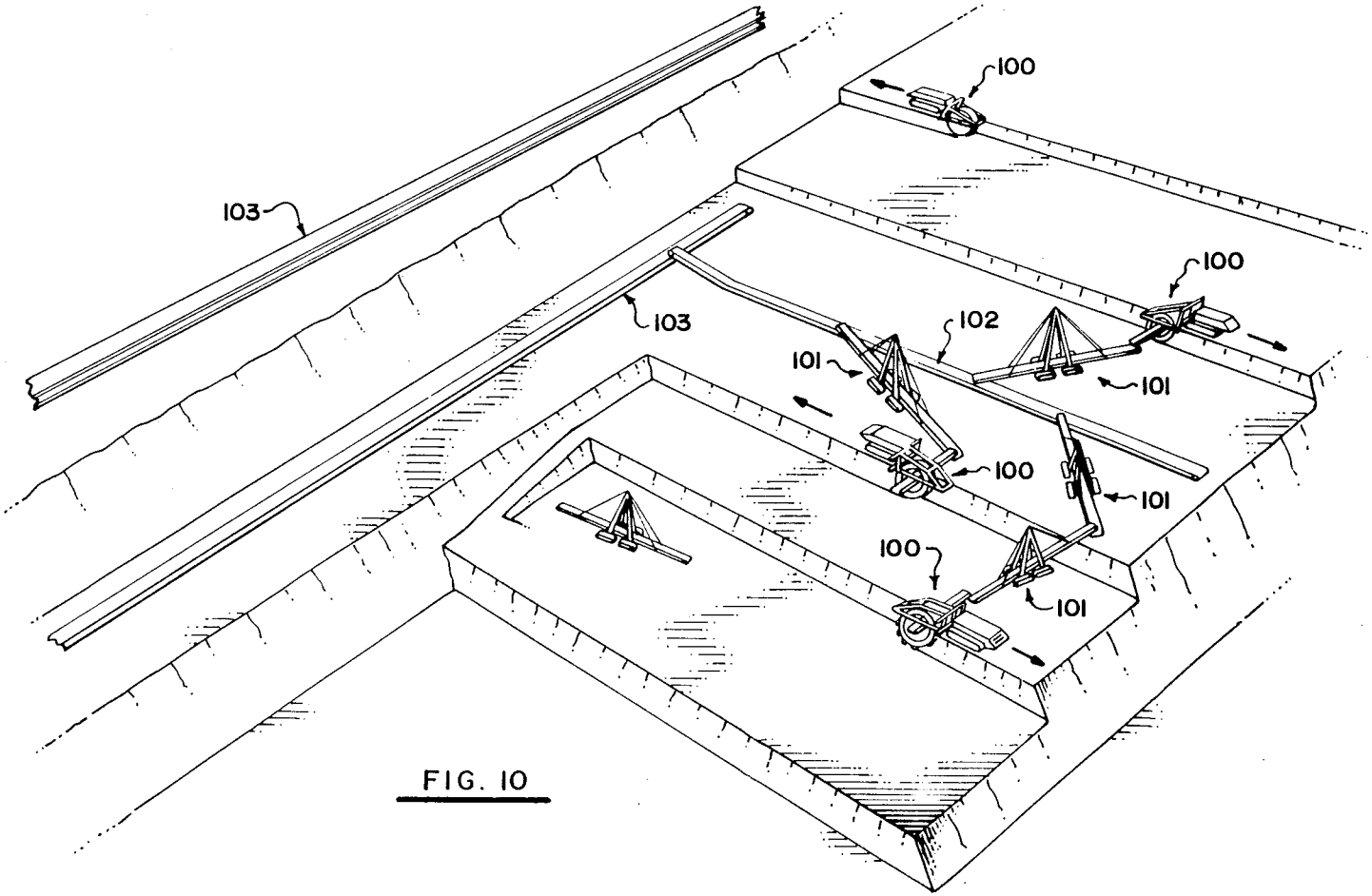
FIG. 10 is a schematic perspective view of a bench mining method according to the invention.

This technique is shown in FIG. 10 in which a number of the units as shown in FIGS. 1, 2 and 3 are shown operating at separate bench lines or cut lines or a bench mine. The units are generally indicated at 100 and it will be noted that two cf the units are traveling in one direction while two are traveling in the opposite direction with the cutting wheel assembly moved to the opposite side of the tractor unit. Material from the cutting wheel is transported on a moveable conveyer 101 which travels along the bench line with the cutting unit. The conveyer 101 trasports the material to a fixed conveyer 102 which receives material from several of the cutting units and transports the material to an outlet conveyer 103 which transports it from the mine to a position of use.

It should be stressed that in the embodiments illustrated, in all cases, the schematic views show the top view of the machine and each machine is depicted taking successive cuts to the right and stepping upwardly on the sheet for the next cut.

For each wheel, the maximum cutting depth is limited to approximately 0.6× the wheel diameter Each wheel is rotating so that the edge in the direction of advance is shown rising out of the page.

The purpose of the tractive unit is to provide tractive effort to move the wheel(s) along the cut, to provide manoeuverability, and to transport the prime mover of the wheel(s) drive.

With reference to the last sentence, tractive effort can be effected by means of crawlers acting against the ground or by means of an onboard winch pulling against a wire rope attached to a deadman at the end of the cut or by other means, as desired.

Each wheel and frame may be outfitted with various quick release or quick change devices to expedite machine maintenance.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

We claim:

1. A method of bench mining a layer of usable product or overburden at the surface of the earth comprising forming three or more separate levels or benches in said layer each separated from the next in height by a substantially vertical cut line defining thereat a higher level and a lower level, providing at each cut line one of a plurality of separate vehicles, each vehicle being powered and driven separately from the other vehicles, moving said one vehicle along said higher level at the cut line in a first direction, mounting on the vehicle an excavator wheel assembly for movement therewith with the wheel assembly at a position rearwardly, downwardly and at least partly to one side of the vehicle, rotating the excavator wheel assembly about a horizontal axis substantially at right angles to the direction of movement, the wheel assembly including a plurality of peripherally arranged digging means whereby movement of the vehicle along the cut line causes the wheel to cut a band of product from the higher level at the cut line down to the lower level, at an end of said cut line, turning the vehicle through 180° so as to move along the cut line in a direction opposed to said first direction, moving the wheel assembly to a position rearwardly, downwardly and to a side of the vehicle opposed to said one side and conveying the cut product from each of the vehicles to a common extraction conveyor.

2. An apparatus for bench mining a layer of a usable product or overburden at the surface of the ground in a method of the type in which a plurality of separate levels or benches are formed in said layer each separated from the next in height by a substantially vertical cut line, the apparatus comprising a wheel excavator assembly arranged for rotation about a substantially horizontal axis, a vehicle for supporting the wheel assembly and having ground engaging support means for movement of the vehicle and wheel assembly in a direction of movement substantially at right angles to said axis of rotation of the wheel with the wheel assembly trailed behind the vehicle, said wheel assembly having a plurality of digger means arranged around its periphery so as to move from a lowermost point on the wheel assembly forwardly and upwardly to cut a band of the product as the wheel assembly rotates and as it is transported forwardly by movement of the vehicle along the ground on said support means, said wheel assembly moveable relative to the vehicle in a direction transversely to the direction cf movement and parallel to the axis of rotation thereof from a first position arranged to cut a band at least part of which lies outwardly beyond one side of said vehicle to a second position arranged to cut a band at least part of which lies outwardly beyond an opposed side of the vehicle and being moveable in a vertical direction to vary the depth of cut to a position below the ground engaging support means of the vehicle, and conveyer means for conveying the product away from the vehicle.

* * * * *